US006222354B1

(12) United States Patent
Song

(10) Patent No.: US 6,222,354 B1
(45) Date of Patent: Apr. 24, 2001

(54) CHARGE COMPENSATOR FOR VOLTAGE REGULATOR

(75) Inventor: Ki-Whan Song, Seoul (KR)

(73) Assignee: Samsung Electronics Co., Ltd., Kyunggki-do (KR)

( * ) Notice: Subject to any disclaimer, the term of this patent is extended or adjusted under 35 U.S.C. 154(b) by 0 days.

(21) Appl. No.: 09/476,517

(22) Filed: Jan. 3, 2000

(30) Foreign Application Priority Data

May 21, 1999 (KR) ..... 99-18451

(51) Int. Cl.[7] ..... G05F 1/40; H03K 5/12
(52) U.S. Cl. ..... 323/273; 327/170
(58) Field of Search ..... 323/273, 275, 323/285, 280, 281; 327/538, 262, 170; 307/591; 365/181

(56) References Cited

U.S. PATENT DOCUMENTS 4,742,247 * 5/1988 Venkatesh ..... 327/51
4,922,458 * 5/1990 Watanabe et al. ..... 365/189.05
6,047,346 * 4/2000 Lau et al. ..... 327/158

* cited by examiner

*Primary Examiner*—Rajnikant D. Patel
(74) *Attorney, Agent, or Firm*—F. Chau & Associates, LLP

(57) ABSTRACT

A charge compensator for a voltage regulator of a semiconductor device includes a process/voltage/temperature (PVT) detector for detecting characteristics of the semiconductor device varying dependent on a manufacturing process, a voltage in use and an operating temperature of the semiconductor device and for outputting state signals representing the detected characteristics; a plurality of pass transistors for providing charge to the load, connected between a power supply voltage and the output of the voltage regulator; and a decoder for selectively driving the plurality of pass transistors based on the state signals from the PVT detector. The charge compensator adjusts the amount of charge supplied to the voltage regulator in accordance with variations of the PVT characteristics, thereby suppressing voltage fluctuations in the output of the voltage regulator.

16 Claims, 9 Drawing Sheets

PVT CHARACTERISTICS

PVT CHARACTERISTICS

CHARGE COMPENSATOR FOR VOLTAGE REGULATOR

BACKGROUND OF THE INVENTION

1. Field of the Invention

The present invention relates to a charge compensator for a voltage regulator in a semiconductor device, and more particularly, to an improved charge compensator for adjusting charge compensation in accordance with characteristics of a semiconductor device.

2. Description of the Related Art

Semiconductor devices need a voltage regulator which is able to generate electric potential of an analog level and to provide appropriate charge required for supplying the generated potential. A voltage regulator generally includes a comparator which detects a difference between an output voltage to a load and a reference voltage, and feeds back the difference to an input of the comparator to maintain the output voltage at the reference voltage level. A gain of the comparator and a feedback speed of the voltage regulator depend on amount of charge drawn per unit time through the output of the voltage regulator. As more charge is drawn through the output of the voltage regulator per unit time, more current is needed to satisfy a required performance demand. As a result, the voltage regulator needs a larger area due to the need for more current, and it causes the size of semiconductors to increase.

In addition to developments in designing efficient voltage regulators, various circuits have been devised to reduce consumption of the charge drawn through the voltage regulator output. One of these circuits is a charge compensator. A charge compensator detects a transition region where a load connected to the voltage regulator output is changed from a steady state to another steady state. At the transition region, the charge compensator provides the load with an appropriate amount of charge from a steady power source, for example, a power supply voltage Vdd.

However, since conventional charge compensators are designed only in consideration of variations in state of the load connected to the voltage regulator output, there is a problem that the charge drawn through the voltage regulator output cannot be properly compensated for variations in operating conditions of a semiconductor device. For example, an amount of the charge drawn by the load connected to the voltage regulator changes depending on manufacturing processes, voltages in use and temperatures of the semiconductor. Nonetheless, the conventional charge compensators are designed regardless of such operating conditions, so that the charge compensators cannot provide an appropriate amount of charge sufficient for compensating for the variations in the operating conditions of a semiconductor.

Therefore, a need exists for a charge compensator for efficiently compensating the charge drawn by the load for variations in the operating conditions and characteristics of a semiconductor.

SUMMARY OF THE INVENTION

An object of the present invention is to provide an improved charge compensator for maintaining a required amount of charge compensation of a charge drawn through an output of a voltage regulator in spite of variations of manufacturing process, voltage in use and temperature in a semiconductor device.

In one aspect of the present invention, there is provided a charge compensator for maintaining a required amount of charge compensation of a charge drawn by a load in a semiconductor device in spite of variations in characteristics of the semiconductor device which depend on manufacturing processes, voltages in use and operating temperatures of the semiconductor device, and the charge compensator is connected to an output of a voltage regulator for regulating the voltage level to be provided to the load. The charge compensator includes a first detector for detecting characteristics of the semiconductor device and for outputting state signals representing the detected characteristics, a plurality of pass transistors for providing charge to the load, the pass transistors connected between a power supply voltage and the output of the voltage regulator, and a decoder for selectively driving the plurality of pass transistors based on the state signals from the first detector. The charge compensator may further include a second detector for detecting a transition region where the load is transited from one state to another state, wherein the decoder selectively turns on the plurality of pass transistors based on the state signals from the first detector and outputs from the second detector. Each of the plurality of pass transistors may provide a different amount of charge, and the decoder may drive one of the plurality of pass transistors based on the state signals from the first detector and the outputs from the second detector. The characteristics of the semiconductor device detected by the first detector may vary dependent on manufacturing processes, voltages in use, and operating temperatures of the semiconductor device.

In another aspect of the present invention, the charge compensator includes a first detector for detecting characteristics of the semiconductor device and for outputting state signals representing the detected characteristics, and a plurality of charge supply paths connected between a power supply voltage and the output of the voltage regulator, wherein the plurality of charge supply paths are selectively operated by the state signals from the first detector. The charge compensator may also include a transition detector for detecting transitions of the load which is transited from one state to another state at each of the transitions, wherein the plurality of charge supply paths are selectively operated based on the state signals from the PVT detector and outputs from the transition region detector. Each of the charge supply paths may provide a different amount of charge compensation. The transition detector may include a node for monitoring the transitions of the load. Each of the plurality of charge supply paths may include at least one transistor having a conduction path between the power supply voltage and the output of the voltage regulator, and the at least one transistor is activated in response to one of the signals output from the PVT detector and the transition detector. The transition detector may provide the plurality of charge supply paths with a first output signal representing a rising transition of the load and a second output signal representing a falling transition of the load. The transition detector may include a first delay circuit for holding the first output signal at a predetermined value for a time period of the rising transition, and a second delay circuit for holding the second output signal at a predetermined value for a time period of the falling transition. The characteristics of the semiconductor device detected by the first detector vary dependent on manufacturing processes, voltages in use, and operating temperatures of the semiconductor device.

These and other objects, features and advantages of the present invention will become apparent from the following detailed description of illustrative embodiments thereof, which is to be read in connection with the accompanying drawings.

BRIEF DESCRIPTION OF THE DRAWINGS

The above objects and advantages of the present invention will become more apparent by describing in detail preferred embodiments thereof with reference to the attached drawings in which.

DESCRIPTION OF PREFERRED EMBODIMENTS

Figure 1:
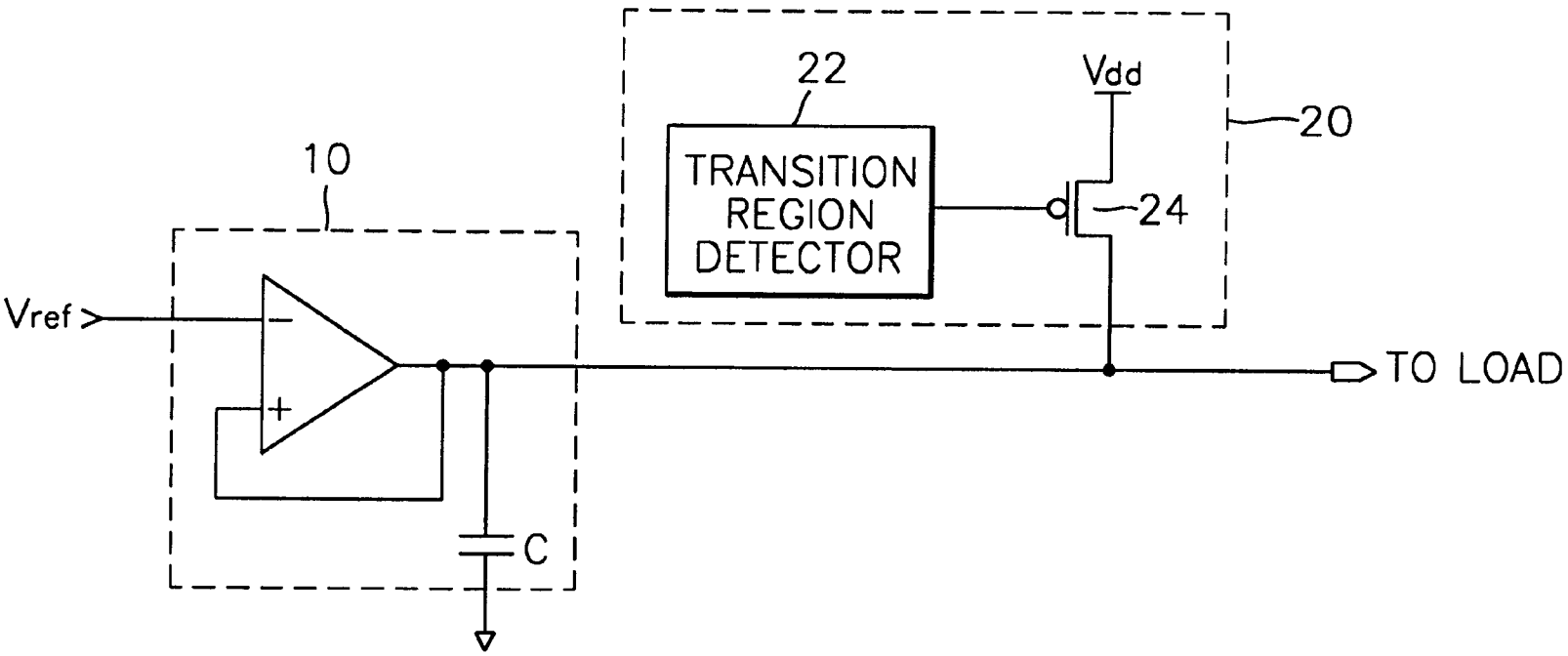
FIG. 1 (PRIOR ART)
FIG. 1 is a block diagram showing a conventional charge compensator.

In FIG. 1, reference numeral 10 represents a voltage regulator for generating a reference voltage and reference numeral 20 represents a conventional charge compensator. The charge compensator 20 includes a transition region detector 22 and a pass transistor 24. The transition region detector 22 detects a transition region of a load (not shown) connected to an output of the voltage regulator 10. At the transition region, more charge is consumed by the load. An output voltage of the voltage regulator 10 is maintained at a reference voltage level by compensating the charge drawn by the load connected to the voltage regulator output. When the transition region is detected by the transition region detector 22, the pass transistor 24 turns on to supply the charge from a power supply source Vdd to the load.

In a semiconductor device, individual elements therein are sensitive to variations operating conditions of the semiconductor, such as a manufacturing process, a voltage in use and an operating temperature. For example, due to the variations in the operating conditions, an element of the semiconductor may show undesired characteristics which differ from initially designed characteristics. According to conditions of a manufacturing process, for example, a transistor may have normal response characteristics or lower or faster response characteristics than values initially set in the transistor.

However, the charge compensator 20 of FIG. 1 cannot efficiently compensate for an amount the charge consumed at the transition region of the load, which varies in accordance with actual characteristics of a semiconductor device depending on a manufacturing process, a voltage in use, and an operating temperature (hereinafter, the operating conditions of a semiconductor device including the characteristics varying dependent on a manufacturing process, a voltage in use and an operating temperature, are called as "PVT characteristics").

To solve this problem of a conventional charge compensator, the present invention is directed to a charge compensator which can compensate for the charge consumed at the transition region of the load and is adjustable according to variations in the PVT conditions of a semiconductor. Thus, the charge compensator according to the present invention can control the supply of the charge to the load in accordance with variations in the PVT characteristics, so that it can advantageously ensure an efficient charge compensation in a semiconductor device.

Figure 2:
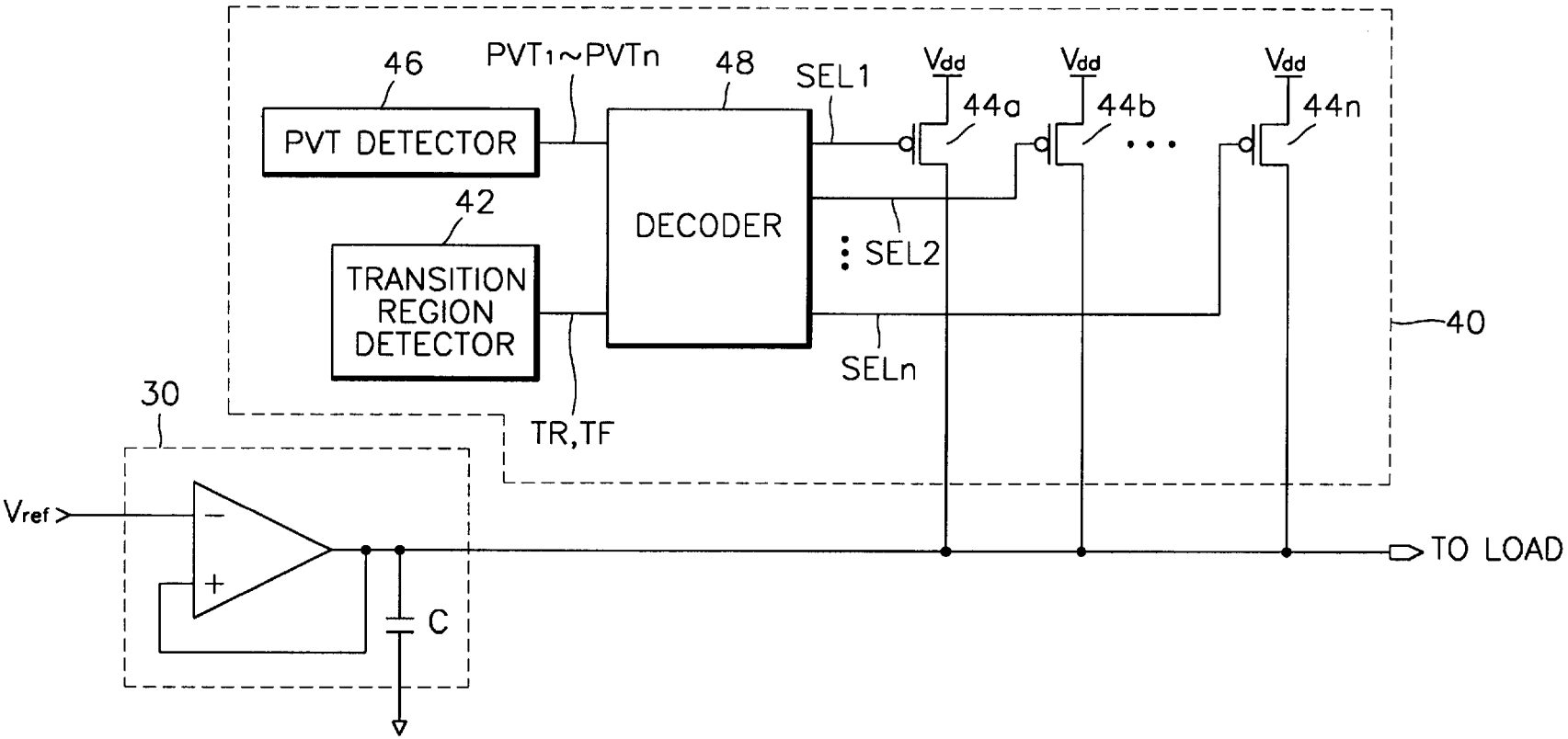
FIG. 2 is a block diagram of a charge compensator according to a preferred embodiment of the present invention.

FIG. 2 is a block diagram of a charge compensator according to a preferred embodiment of the present invention. In FIG. 2, reference numeral 30 represents a voltage regulator and reference numeral 40 represents a charge compensator of the present invention. The charge compensator 40 includes a transition region detector 42, a PVT detector 46, a decoder 48, and a plurality of pass transistors 44*a* through 44*n* which are driven by outputs from the decoder 48.

The transition region detector 42 generates signals TR and TF representing a transition region of a load (not shown) connected to an output of the voltage regulator 30. The plurality of pass transistors 44*a* through 44*n* are connected in parallel between a power supply voltage Vdd and the voltage regulator 30. Each of the pass transistors 44*a* to 44*n* provides a different amount of charge. The PVT detector 46 generates n state signals PVT1 through PVTn representing various PVT characteristics by combinations of the n state signals. The decoder 48 generates selection signals SEL1 through SELn to select one of the n pass transistors 44*a* through 44*n* based on the n state signals PVT1 through PVTn from the PVT detector 46 and the output signals TR and TF from the transition region detector 42. The n pass transistors 44*a* through 44*n* are driven by the selection signals SELL through SELn. The charge compensator 40 adjustably compensates an amount of the charge drawn by the load in accordance with the transition region of the load detected by the transition region detector 42 and the PVT characteristics detected by the PVT detector 46. Thus, an efficient supply of charge to the load can be achieved under a wide range of variations in the PVT characteristics.

Figure 3:
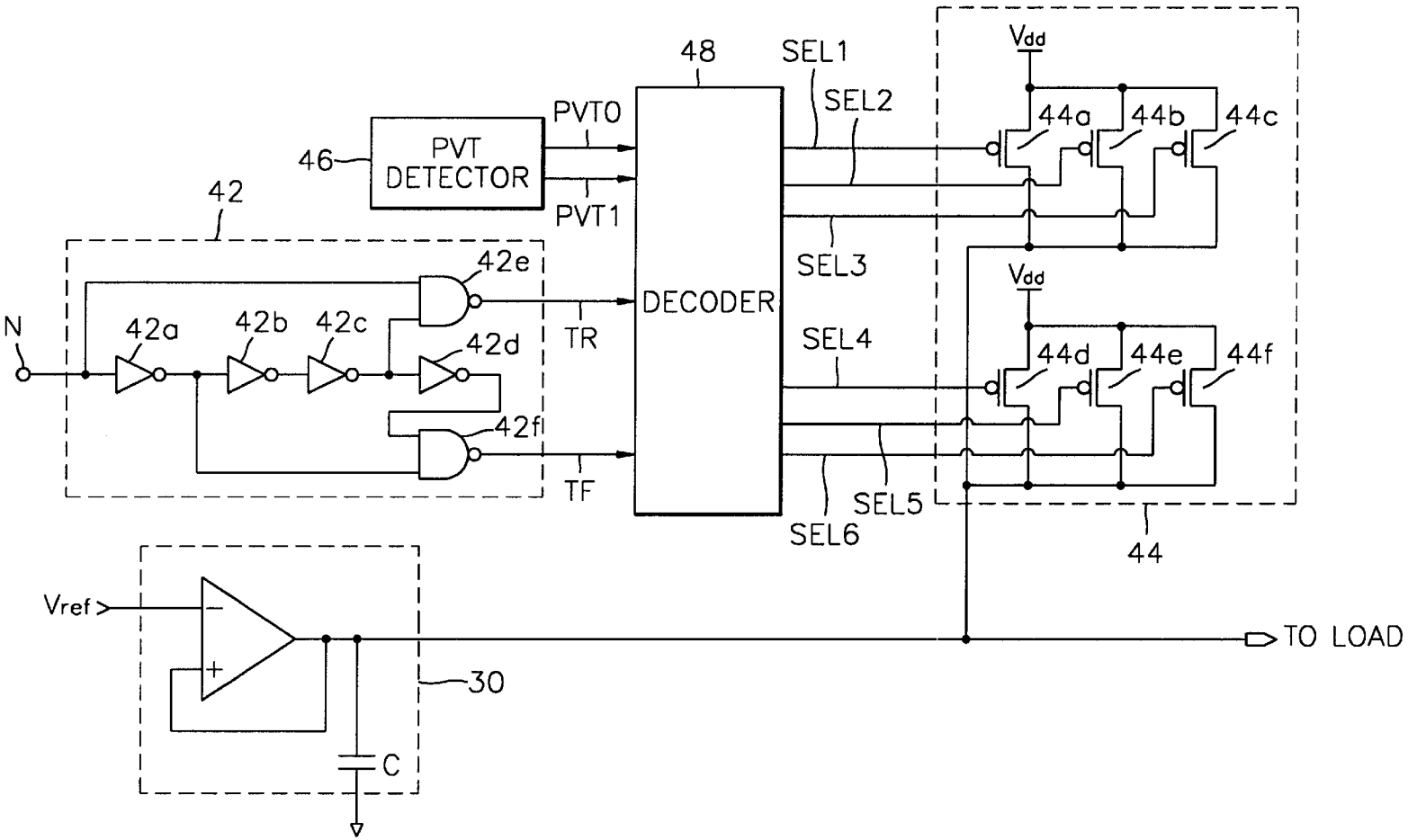
FIG. 3 is a detailed diagram of the charge compensator in FIG. 2.

FIG. 3 is a circuit diagram showing a preferred embodiment of the charge compensator 40 in FIG. 2. Referring to FIG. 3, the transition region detector 42 includes four inverters 42*a* through 42*d* and two NAND gates 42*e* and 42*f*. An input of the transition region detector 42 is coupled to a transition monitoring node N. The transition monitoring node N may be an output of a load, for example, a sense amplifier, which is operated by a reference voltage provided by the voltage regulator 30. The load such as a sense amplifier outputs a digital signal having two transitions, i.e., rising and falling transitions.

The four inverters 42*a* through 42*d* act to delay. A rising transition at the transition monitoring node N is detected by the first NAND gate 42*e* and a falling transition at the transition monitoring node N is detected by the second NAND gate 42*f*. When the transition monitoring node N is at a steady state, for example, a low or a high level, an output signal TR of the first NAND gate 42*e* and an output signal TF of the second NAND gate 42*f* are "high". That is, because an input to the first inverter 42*a* and an output from the third inverter 42*c* are opposite to each other, the output signal TR of the first NAND gate 42*e* becomes "high". Also, an input to the second inverter 42*b* is opposite to an output from the fourth inverter 42*d*, so that the output signal RF from the second NAND gate 42*f* becomes "high".

For a period of the transition at the transition monitoring node N, the output signal TR from the first NAND gate 42*e* becomes "low" (for example, in case of the rising transition) or the output signal TF from the second NAND gate 42*f* becomes "low" (for example, in case of the falling transition). During the rising transition, the TR signal from the first NAND gate 42*e* is held at a low level for a period of a delay due to the three inverters 42*a,* 42*b* and 42*c*. During the falling transition, the TF signal from the second NAND gate 42*f* remains at a logic low for a period of a delay due to the three inverters 42*b,* 42*c* and 42*d* after a period to which a rising edge output from the second NAND gate 42*f* is delayed by the inverter 42*a*.

In FIG. 3, six pass transistors 44*a* through 44*f* are connected in parallel between the power supply voltage Vdd and the output of the voltage regulator 30. Each of the pass transistors 44*a* through 44*f* may be, for example, a PMOS transistor. The PVT detector 46 through which a reference current flows is utilized in a rambus DRAM, and is used for comparison between voltage drops in semiconductor devices having different sizes, for example, small, medium and large to detect the PVT characteristics of a semiconductor. The PVT detector 46 outputs two state signals PVT0 and PVT1 to represent the PVT characteristics detected. It is assumed that the state signal PVT0 is activated to "low" at a condition of a slow response characteristic (ss)/2.25V 110° C., and the state signal PVT1 is activated to "low" at a condition of a fast response characteristic (ff)/2.625V/0° C., and both the signals PVTO and PVT1 are activated to "high" at a condition of a normal response characteristic (tt)/2.5V/65° C..

The decoder 48 generates six selection signals SEL1 through SEL6 to drive the six pass transistors 44*a* through 44*f* based on the state signals PVT0 and PVT1 from the PVT detector 46 and the output signals TR and TF from the transition region detector 42.

Table 1 is a truth table which illustrates operations of the decoder 48 of FIG. 3.

TABLE 1

| TR | TF | PVT0 | PVT1 | Selection signal |
|---|---|---|---|---|
| 0 | 1 | 0 | 1 | SEL1 |
| 0 | 1 | 1 | 1 | SEL2 |
| 0 | 1 | 1 | 0 | SEL3 |
| 1 | 0 | 0 | 1 | SEL4 |
| 1 | 0 | 1 | 1 | SEL5 |
| 1 | 0 | 1 | 0 | SEL6 |

In general, more current is consumed in the rising transition than in the falling transition, and more current is required in a semiconductor device with the slow response characteristic than in a semiconductor device with the fast response characteristic. Thus, the amount of charge consumed in a semiconductor device gradually decreases depending on conditions of the semiconductor in order of the following: a condition with the slow response characteristic at the rising transition, a condition with the normal response characteristic at the rising transition, a condition with the fast response characteristic at the rising transition, a condition with the slow response characteristic at the falling transition, a condition with the normal response characteristic at the falling transition, and a condition with the fast response characteristic at the falling transition. Thus, an amount of charge compensation is adjusted in accordance with the each condition.

In Table 1, the first through third rows illustrate decoding operations during the rising transitions at the transition monitoring node N (TR=0), and the fourth through sixth rows illustrate decoding operations during the falling transition at the transitions monitoring node N (TF=0).

The first row represents the condition of the slow response characteristic (ss)/2.25V110° C. at the rising transition, where TR=0, PVT0=0 and SEL1=0. The second row represents the condition of the normal response characteristic (tt)/2.5V/65° C. at the rising transition, where TR=0, PVT0=1, PVT1=1 and SEL2=0. The third row represents the condition of the fast response characteristic (ff) /2.625V/0° C. at the rising transition, where TR=0, PVT1=0 and SEL3=0. The fourth row represents the condition of the slow response characteristic (ss)/2.25V110° C. at the falling transition, where TF=0, PVT0=0 and SEL4=0. The fifth row represents the condition of the normal response characteristic (tt)2.5V/65° C. at the falling transition, where TF=0, PVT0=1, PVT1=1 and SEL5=0. The sixth row represents the condition of the fast response characteristic (ff)/2.625V/0° C. at the falling transition, where TF=0, PVT1=0 and SEL6=0.

Thus, the amount of current consumed in a semiconductor is maximum under the conditions corresponding to the first row, and the amount of the consumed current is sequentially decreased under the conditions of the second through fifth rows and decreased to a minimum under the conditions corresponding to the sixth row.

The selection signals SEL1 through SEL6 from the decoder 48 are provided to gates of the first through sixth pass transistors 44*a* through 44*f*, respectively. Here, current drive capabilities of the respective pass transistors sequentially decrease in the order from the first to the sixth pass transistor 44*a* through 44*f*.

According to TABLE 1, the first pass transistor 44*a* is turned on under the conditions of the first row, the second pass transistor 44*b* is turned on under the conditions of the second row, the third pass transistor 44*c* is turned on under the conditions of the third row, the fourth pass transistor 44*d* is turned on under the conditions of the fourth row, the fifth pass transistor 44*e* is turned on under the conditions of the fifth row, and the sixth pass transistor 44*f* is turned on under the conditions of the sixth row.

In the charge compensator of FIG. 3, the two state signals PVT0 and PVT1, each representing a different state, are provided by the PVT detector 46, and the six pass transistors 44*a* through 44*f* are used. However, it is apparent that the number of the state signals and the pass transistors may be varied.

Figure 4:
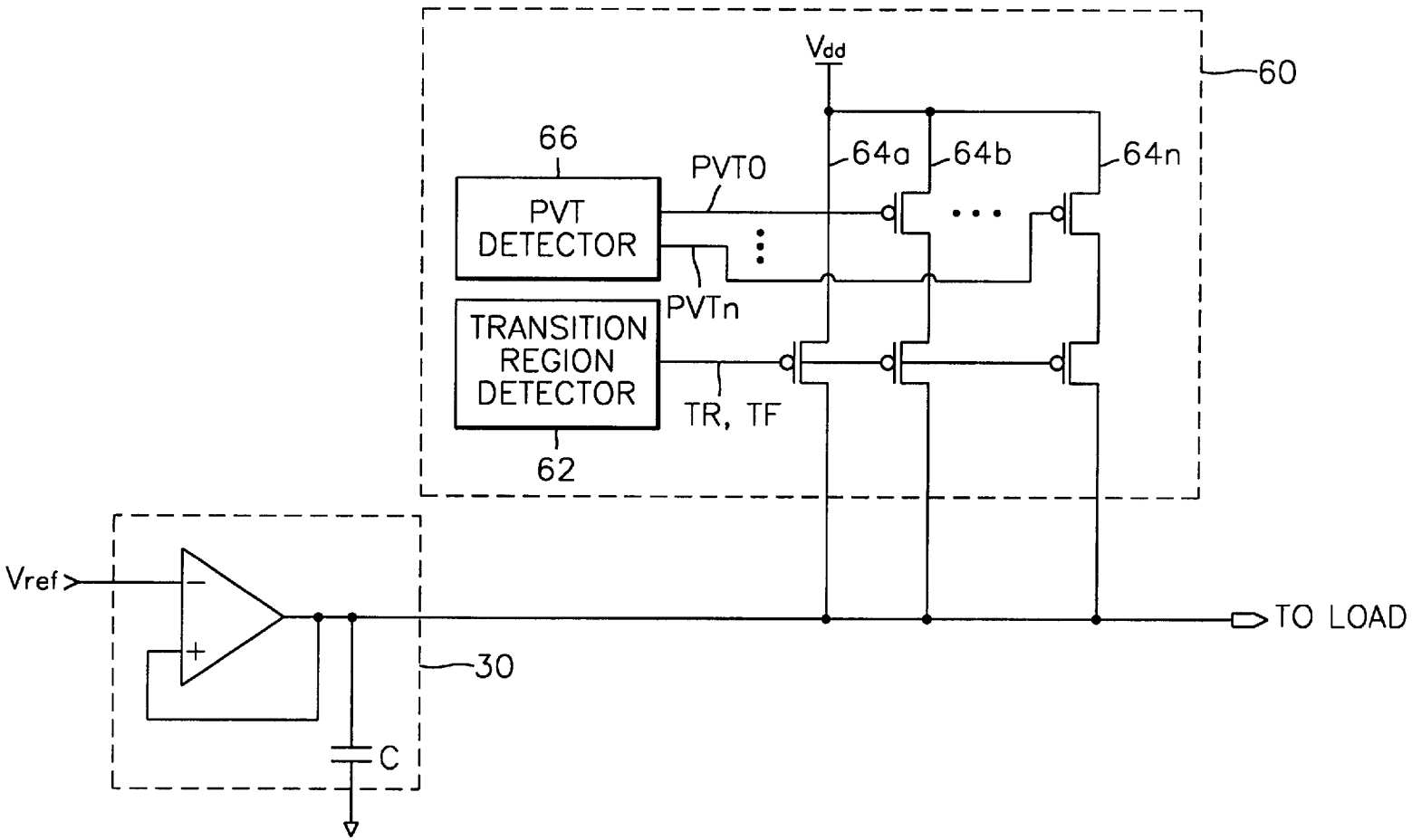
FIG. 4 is a block diagram of a charge compensator according to another preferred embodiment of the present invention.

FIG. 4 is a block diagram of a charge compensator according to another embodiment of the present invention. The charge compensator 60 of FIG. 4 includes a plurality of charge supply paths 64*a* through 64*n* arranged in such a way as to replace the decoder of FIG. 2. The respective charge supply paths 64*a* through 64*n* are open or closed in response to output signals from a PVT detector 66 and a transition region detector 62. In FIG. 4, reference number 30 represents a voltage regulator.

The charge compensator 60 of FIG. 4 includes a transition region detector 62, a PVT detector 66 and n charge supply paths 64*a* through 64*n*. The transition region detector 62 generates signals TR and TF representing a transition of a load (not shown) connected to an output of the voltage regulator 30. The n charge supply paths 64*a* through 64*n* are connected in parallel between an power supply voltage Vdd and an output of the voltage regulator 30, each of which provides a different amount of charge. The PVT detector 66 generates n state signals PVT1 through PVTn, which represent various PVT characteristics by combinations of the n state signals. The n charge supply paths 64*a* through 64*n* are controlled by combinations of the output signals TR and TF from the transition region detector 62 and the n state signals PVT1 through PVTn from the PVT detector 66. Thus, the charge compensator 60 adjusts the amount of charge compensation in accordance with the transition of the load and the PVT characteristics of a semiconductor, so that an efficient supply of charge can be achieved under a wide range of the PVT characteristics.

Figure 5:
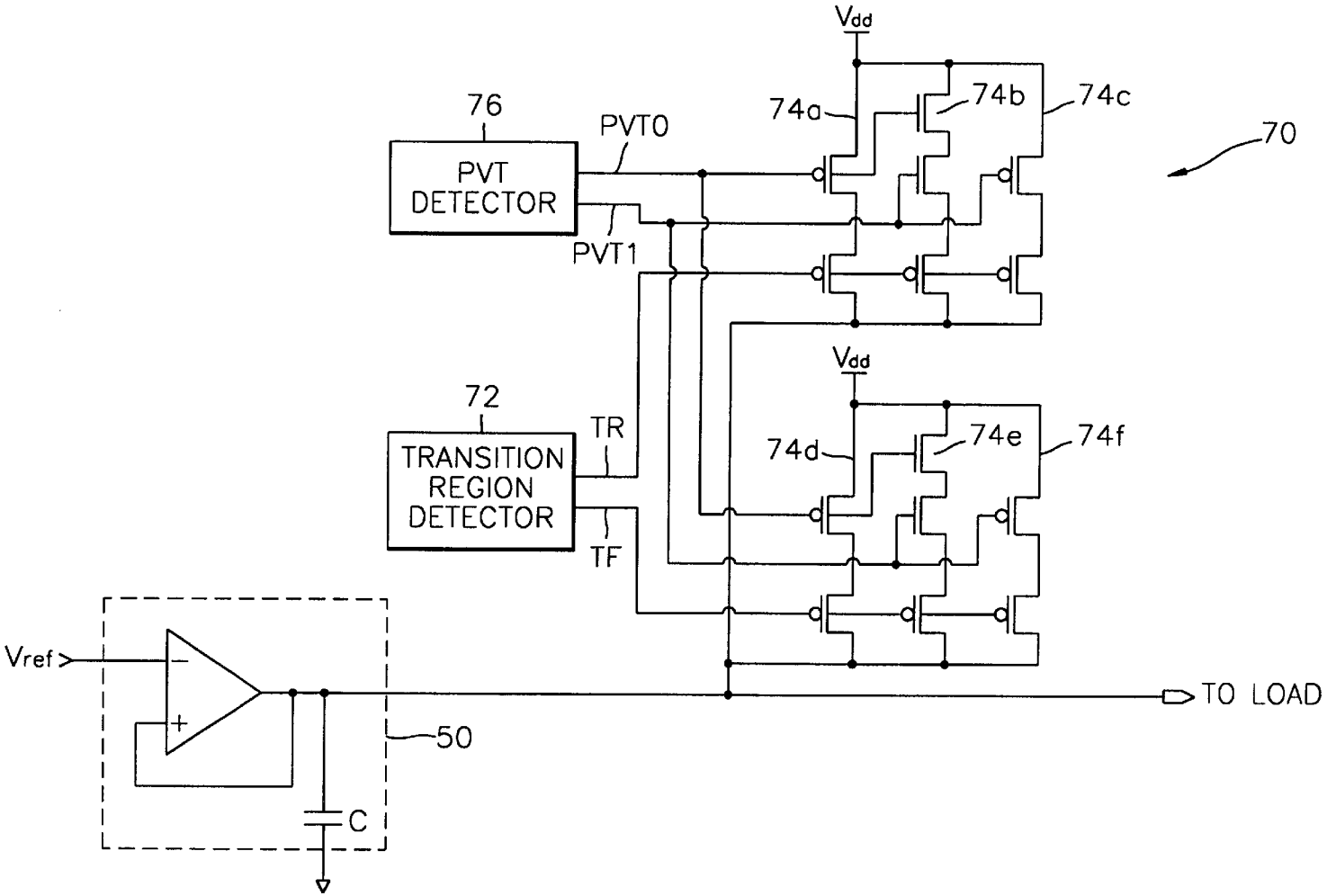
FIG. 5 is a block diagram of a charge compensator according to another embodiment of the present invention.

FIG. 5 is a block diagram of a charge compensator according to another embodiment of the present invention. Table 2 below is a truth table which illustrates operations of first through sixth charge supply paths 74*a* through 74*f* of the charge compensator 70.

TABLE 2

| TR | TF | PVT0 | PVT1 | Path selected |
|---|---|---|---|---|
| 0 | 1 | 0 | 1 | First |
| 0 | 1 | 1 | 1 | Second |
| 0 | 1 | 1 | 0 | Third |
| 1 | 0 | 0 | 1 | Fourth |
| 1 | 0 | 1 | 1 | Fifth |
| 1 | 0 | 1 | 0 | Sixth |

In Table 2, the first through third rows illustrate operations during the rising transitions at the transition monitoring node N (TR=0), and the fourth through sixth rows illustrate operations during the falling transitions at the transition monitoring node N (TF=0).

The first row represents the condition of the slow response characteristic (ss)/2.25V/110° C. at the rising transition, where TR=0, PVT0=O and the first charge supply path 74*a* is selected. The second row represents the condition of the normal response characteristic (tt)/2.5V/65° C. at the rising transition, where TR=0, PVT0=1, PVT1=1 and the second charge supply path 74*b* is selected. The third row represents the condition of the fast response characteristic (ff)/2.625V/0° C. at the rising transition, where TR=0, PVT1=0 and the third charge supply path 74*c* is selected. The fourth row represents the condition of the slow response characteristic (ss)/2.25V/110° C. at the falling transition, where TF=0, PVT0=0 and the fourth charge supply path 74*d* is selected. The fifth row represents the condition of the normal response characteristic (tt)/2.5V/65° C. at the falling transition, where TF=0, PVT0=1, PVT1=1 and the fifth charge supply path 74*e* is selected. The sixth row represents the condition of the fast response characteristic (ff)/2.625V/0° C. at the falling transition, where TF=0, PVT1=0 and the sixth charge supply path 74*f* is selected.

Thus, the amount of current consumed in a semiconductor is maximum under the conditions corresponding to the first row, and the amount of the consumed current consumed is sequentially decreased to a minimum under the conditions corresponding to the sixth row. Also, current drive capabilities of pass transistors sequentially decrease in the order from the first to the sixth charge supply paths 74*a* through 74*f*.

The first charge supply path 74*a* includes two PMOS transistors to the gates of which the signal TR from the transition region detector 72 and the state signal PVT0 from the PVT detector 76 are applied, respectively. Thus, the first charge supply path 74*a* supplies charge to the load under the condition of the slow response characteristic (ss)/2.25V/110°0 C. during a rising transition at the transition monitoring node N. The second charge supply path 74*b* includes one PMOS transistor having a gate to which the signal TR from the transition region detector 72 is applied, and two NMOS transistors each having a gate to which each of the state signals PVT0 and PVT1 from the PVT detector 76 are applied, respectively. Thus, the second charge supply path 74*b* supplies charge to the load at the condition of the normal response characteristic (tt)/2.5V/65° C. during a rising transition at the transition monitoring node. The third charge supply path 74*c* includes two PMOS transistors to the gates of which the signal TR from the transition region detector 72 and the state signal PVT1 from the PVT detector 76 are applied, respectively. Thus, the third charge supply path 74*c* supplies charge to the load at the condition of the fast response characteristic (ff)/2.625V/0° C. during a rising transition at the transition monitoring node. Also, the configuration and structure of the fourth through sixth charge supply paths 74*d* through 74*f* are the same as those of the first through third charge supply paths 74*a* through 74*c*, except that the fourth through sixth charge supply paths 74*d* through 74*f* are operated during a falling transition at the transition monitoring node.

A charge compensator according to the present invention of which preferred embodiments are shown in FIGS. 2 through 5, drives one of the pass transistors or the charge supply paths in accordance with a required current drive capability. However, a charge compensator according to the present invention can be constructed by combining the pass transistors and the charge supply paths such that it can satisfy a need of current drive capability. In such cases, the charge compensator is designed such that the condition of the fast response characteristic (ff)/2.625V/0° C. is set to a continuous charge supply condition, and additional charge is supplemented at the condition of the normal response characteristic/2.5V/65° C. or the condition of slow response characteristic/2.25V/110° C.

Figure 6A:
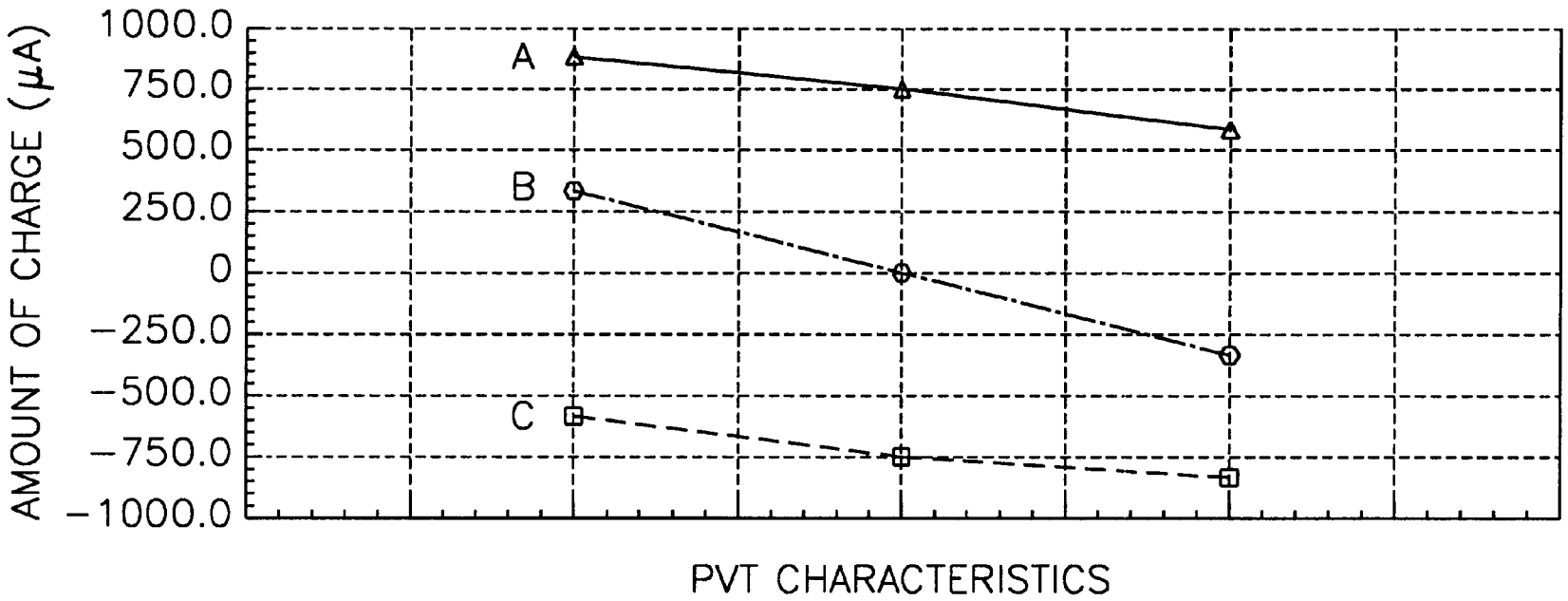
FIG. 6A (PRIOR ART)
FIGS. 6A and 6B are graphs illustrating operations of the conventional charge compensator in FIG. 1.
Figure 6B:
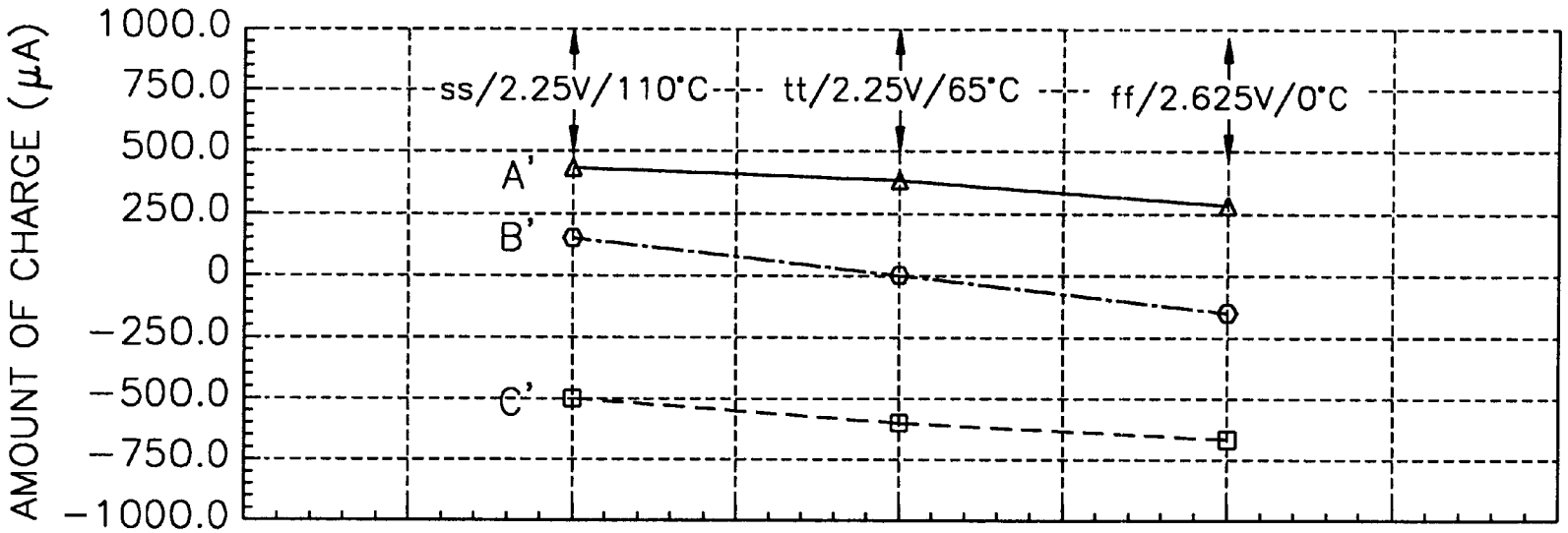
FIG. 6B (PRIOR ART)
Figure 7A:
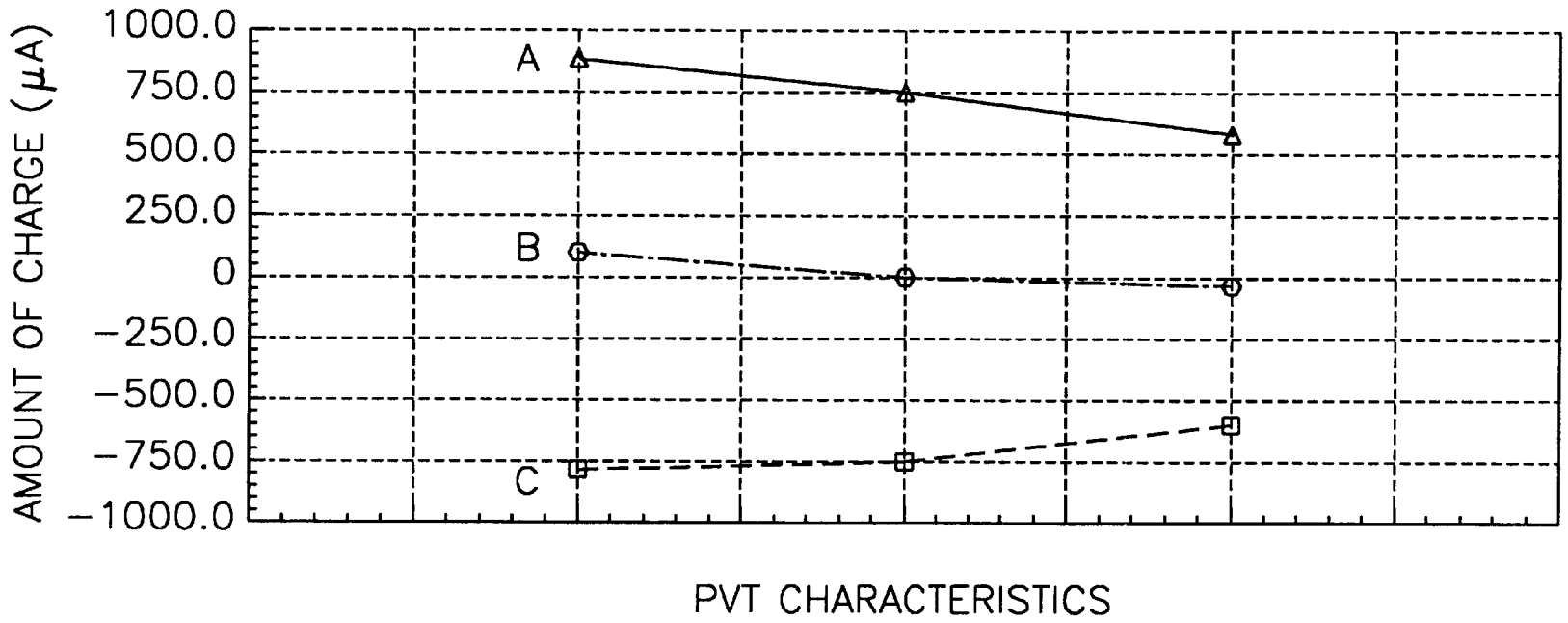
FIGS. 7A and 7B are graphs illustrating operations of a charge compensator according to the present invention.
Figure 7B:
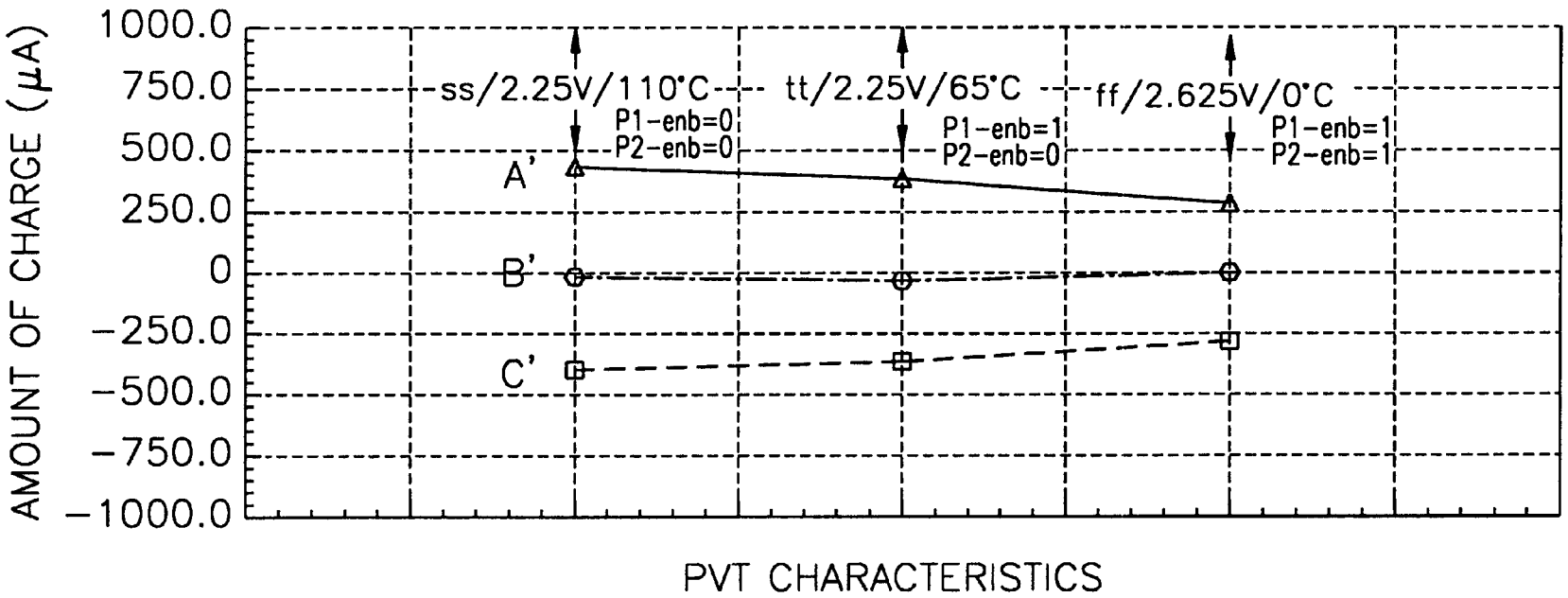

FIGS. 6A through 6B are graphs illustrating the operation of the conventional charge compensator shown in FIG. 1, and FIGS. 7A through 7B are graphs illustrating the operation of the charge compensator according to the present invention, shown in FIGS. 2 through 5. FIGS. 6A and 7A illustrate the charge compensation at a rising transition, and FIGS. 6B and 7B illustrates the charge compensation at a falling transition. In FIGS. 6A to 7B, the X-axis represents the PVT characteristics, and the Y-axis represents the amount of charge. Also, upper solid lines A and A' represent the amount of charge drawn by the load, lower dashed lines C and C' represent the amount of charge compensation by the charge compensator, and middle dotted and dashed lines B and B' represent the amount of charge taken from the output of the voltage regulator.

Assuming that the amount of charge drawn by the load is A, the amount of charge supplied by the charge compensator is C, and the amount of charge at the output of the voltage regulator is B, the amount of charge at the output of the voltage regulator B can be expressed as follows:

$$B=A-|C|$$

As A and C symmetrically change, fluctuations of B become smaller.

Referring back to FIGS. 6A to 7B, the points in the center of the respective graphs correspond to the condition of the normal response characteristic (tt)/2.5V/65° C., the points on the left of the respective graphs correspond to the condition of the slow response characteristic (ss)/2.25V/110° C., and the points on the right of the respective graphs correspond to the condition of the fast response characteristic (ff)2.625V0° C. Compared with the normal response characteristic, the points on the left and the right of the respective graphs represent substantially extreme conditions of the slow and fast response characteristics, respectively.

Referring to FIG. 6A, in the conventional charge compensator which is designed to exhibit optimal characteristics at the condition of the normal response characteristic (tt)/2.25V/110° C., the charge drawn by the load is not appropriately compensated for by about 260 $\mu$A at both the slow and fast operation conditions during a rising transition. Referring to FIG. 6B, the amount of charge compensation is insufficient as much as about 110 $\mu$A at both the slow and fast operation conditions during a falling transition.

Referring to FIGS. 7A and 7B, since the charge compensator according to the present invention can properly supply charge in accordance with the PVT characteristics, the maximum compensation error is reduced to about 60 $\mu$A during the rising and falling transitions under the three operation conditions. The compensation error in the charge compensator of the present invention is about one fifth of that in the conventional charge compensator.

As described above, the charge compensator according to the present invention can adjust the amount of charge supplied to the voltage regulator in accordance with variations of the PVT characteristics, thereby suppressing voltage fluctuations at the output of the voltage regulator and ensuring the steady operation of a semiconductor device. Also, due to the decrease in voltage fluctuations at the output of the voltage regulator, the load of the voltage regulator can be advantageously reduced in aspects of current consumption and layout area.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A charge compensator for maintaining a required amount of charge compensation of a charge drawn by a load in a semiconductor device, the charge compensator connected to an output of a voltage regulator for regulating a voltage level to be provided to the load, the charge compensator comprising:

a first detector for detecting characteristics of the semiconductor device and for outputting state signals representing the detected characteristics;

a plurality of pass transistors for providing charge to the load, to compensate for discharge due to transitioning of the load and variations in semiconductor characteristics, the pass transistors connected between a power supply voltage and the output of the voltage regulator;

a second detector for detecting a transition region where the load is transited from one state to another state; and a decoder for decoding signals from the first and second detectors and for selectively driving one of the plurality of pass transistors based on the state signals from the first detector and outputs from the second detector.

2. The charge compensator of claim 1, wherein each of the plurality of pass transistors provides a different amount of charge, to compensate for discharge due to transitioning of the load and variations in semiconductor characteristics.

3. The charge compensator of claim 1, wherein the characteristics of the semiconductor device detected by the first detector vary dependent on manufacturing processes, voltages in use, and operating temperatures of the semiconductor device.

4. A charge compensator for maintaining a required amount of charge compensation of a charge drawn by a load in a semiconductor device, the charge compensator connected to an output of a voltage regulator for regulating a voltage level to be provided to the load, the charge compensator comprising:

a process-voltage-temperature (PVT) detector for detecting characteristics of the semiconductor device and for outputting state signals representing the detected characteristics;

a transition detector for detecting transitions of the load which is transited from one state to another state at each of the transitions: and a plurality of charge supply passes connected between a power supply voltage and the output of the voltage regulator, the plurality of charge supply passes being selectively operated by the state signals from the PVT detector and outputs of the transition detector, to compensate for discharge due to transitioning of the load and variations of semiconductor characteristics.

5. The charge compensator of claim 4, wherein each of the charge supply paths provides a different amount of charge compensation.

6. The charge compensator of claim 4, wherein the transition detector includes a node for monitoring the transitions of the load.

7. The charge compensator of claim 4, wherein each of the plurality of charge supply paths includes at least one transistor having a conduction path between the power supply voltage and the output of the voltage regulator, the at least one transistor being activated in response to one of the signals output from the PVT detector and the transition detector.

8. The charge compensator of claim 4, wherein the transition detector provides the plurality of charge supply paths with a first output signal representing a rising transition of the load and a second output signal representing a falling transition of the load.

9. The charge compensator of claim 8, wherein the transition detector includes:

a first delay circuit for holding the first output signal at a predetermined value for a time period of the rising transition; and a second delay circuit for holding the second output signal at a predetermined value for a time period of the falling transition.

10. The charge compensator of claim 4, wherein the characteristics of the semiconductor device detected by the PVT detector vary dependent on manufacturing process, voltages in use, and operating temperatures of the semiconductor device.

11. A charge compensator for compensating a charge drawn from a voltage regulator by a load in a semiconductor device, the charge compensator comprising:

a first detector for detecting characteristics of the semiconductor device and for outputting state signals to represent the detected characteristics;

a second detector for detecting transitions of the load which is transited from one state to another state at each of the transitions, and for generating output signals to represent the detected transitions;

a plurality of pass transistors connected between a voltage supply and an output of the voltage regulator, to compensate for discharge due to transitioning of the load and variations in semiconductor characteristics; and a decoder for selectively driving the plurality of pass transistors in response to the state signals from the first detector and the output signals form the second detector.

12. The charge compensator of claim 11, wherein the first detector includes a means for detecting conditions of a manufacturing process, a voltage in use, and a temperature of the semiconductor device.

13. The charge compensator of claim 11, wherein the decoder generates selection signals for selecting one of the plurality of the pass transistors, the selected pass transistor supplying a predetermined amount of charge to the output of the voltage regulator from the voltage supply.

14. The charge compensator of claim 11, wherein the second detector includes:

a first delay circuit for holding a first output signal representing a rising transition at a predetermined value for a time period of the rising transition; and a second delay circuit for holding a second output signal representing a falling transition at a predetermined value for a time period of the falling transition.

15. The charge compensator of claim 14, wherein the first delay circuit includes:

a plurality of inverters connected in series, a first inverter having an input connected to a node for monitoring the transitions of the load; and a logic circuit having a first input connected to the input of the first inverter and a second input connected to an output of a last inverter of the plurality of the inverters, the logic circuit operating a predetermined logic with signals received via the first and second inputs to provide the first output signal to the decoder.

16. The charge compensator of claim 14, wherein the second delay circuit includes:

a plurality of inverters connected in series, a first inverter having an input connected to a node for monitoring the transitions of the load; and a logic circuit having a first input connected to the input of the first inverter and a second input connected to an output of a last inverter of the plurality of the inverters, the logic circuit operating a predetermined logic with signals received via the first and second inputs to provide the second output signal to the decoder.

* * * * *